US009316085B2

(12) United States Patent
Fuglestad

(10) Patent No.: US 9,316,085 B2
(45) Date of Patent: Apr. 19, 2016

(54) EXPANDING ELASTOMER/PLUG DEVICE FOR SEALING BORE HOLE AND PIPELINES

(75) Inventor: Kenneth Fuglestad, Bryne (NO)

(73) Assignee: WELL INNOVATION ENGINEERING AS, Stavanger (NO)

( * ) Notice: Subject to any disclaimer, the term of this patent is extended or adjusted under 35 U.S.C. 154(b) by 626 days.

(21) Appl. No.: 13/812,258

(22) PCT Filed: Jul. 19, 2011

(86) PCT No.: PCT/NO2011/000210

§ 371 (c)(1),
(2), (4) Date: Apr. 4, 2013

(87) PCT Pub. No.: WO2012/015311

PCT Pub. Date: Feb. 2, 2012

(65) Prior Publication Data

US 2013/0180705 A1 Jul. 18, 2013

(30) Foreign Application Priority Data

Jul. 28, 2010 (NO) ..... 20101076

(51) Int. Cl.
*E21B 33/128* (2006.01)
*E21B 33/12* (2006.01)
*E21B 23/06* (2006.01)

(52) U.S. Cl.
CPC ..... *E21B 33/128* (2013.01); *E21B 23/06* (2013.01); *E21B 33/1216* (2013.01)

(58) Field of Classification Search
CPC ..... E21B 33/1216; E21B 33/1208; E21B 33/128; E21B 33/1293; E21B 23/06; E21B 33/1204; E21B 34/102
See application file for complete search history.

(56) References Cited

U.S. PATENT DOCUMENTS 4,531,581 A 7/1985 Pringle et al.
4,538,685 A 9/1985 Pringle et al.
4,611,658 A * 9/1986 Salerni ..... E21B 33/1216 166/120
5,492,173 A 2/1996 Kilgore et al.
6,343,791 B1 * 2/2002 Anyan ..... E21B 33/128 277/337

(Continued)

FOREIGN PATENT DOCUMENTS

GB 2467040 A 7/2010

OTHER PUBLICATIONS

International Search Report issued Oct. 19, 2011 in corresponding International Application No. PCT/NO2011/000210.

(Continued)

*Primary Examiner* — Daniel P Stephenson
(74) *Attorney, Agent, or Firm* — Wenderoth, Lind & Ponack, L.L.P.

(57) ABSTRACT

The present invention relates to a downhole plug with an expandable elastomeric packer (1) having two ends, surrounding a main section (25). The intended application of the downhole plug is for sealing wellbores and tubulars (4). At least one expansion ring (13) adjoins at least one of said two ends of the elastomeric packer (1), and at least one support ring (15) applies an axial force (16) in a longitudinal direction of the downhole plug. At least one of said two ends of the elastomeric packer (1) is made with a tapered surface. The at least one expansion ring (13) is made with a tapered surface configured in such a manner that the application of the axial force (16) in a longitudinal direction of the downhole plug leads to the simultaneous expansion of the elastomeric packer (1) and the at least one expansion ring (13).

20 Claims, 7 Drawing Sheets

(56) References Cited

U.S. PATENT DOCUMENTS

| | | | | |
|---|---|---|---|---|
| 6,467,540 | B1 | 10/2002 | Weinig et al. | |
| 6,619,391 | B2 | 9/2003 | Weinig et al. | |
| 7,735,549 | B1 * | 6/2010 | Nish | E21B 33/134 166/134 |
| 8,579,023 | B1 * | 11/2013 | Nish | E21B 33/128 166/118 |
| 8,997,859 | B1 * | 4/2015 | Ackermann | E21B 33/134 166/242.8 |
| 9,080,423 | B2 * | 7/2015 | Streater, Jr. | E21B 31/18 |
| 2002/0070503 | A1 | 6/2002 | Zimmerman et al. | |
| 2003/0034159 | A1 | 2/2003 | Weinig et al. | |
| 2004/0036225 | A1 | 2/2004 | Ritter et al. | |
| 2008/0264627 | A1 * | 10/2008 | Roberts | E21B 23/01 166/118 |
| 2010/0186970 | A1 | 7/2010 | Burnett et al. | |
| 2013/0180705 | A1 * | 7/2013 | Fuglestad | E21B 33/128 166/135 |

OTHER PUBLICATIONS

International Preliminary Report on Patentability issued Oct. 9, 2012 in corresponding International Application No. PCT/NO2011/000210.

Norwegian Search Report issued Feb. 22, 2011 in corresponding Norwegian Application No. 20101076.

* cited by examiner

EXPANDING ELASTOMER/PLUG DEVICE FOR SEALING BORE HOLE AND PIPELINES

The present invention relates to an arrangement used for forming a seal or barrier between two tubulars in a pipe-in-pipe configuration.

A plug is used in a well for providing an annular seal between an inner pipe section and an outer tubular conduit, such as a wellbore wall, for example.

In the completion of oil and gas recovery wells, various components are used for the purpose of creating a passageway for hydrocarbons and gas from the reservoir to the surface. The completion of a well is accomplished in different ways. Commonly, two of the main parts of the completion are a lower component suspended from pipelines extending from the surface and an upper component providing a seal between the pipeline and the lower component. Normally the lower component is cemented in place in the well. One of the main elements included in the upper component of the completion described is a plug for creating a seal/barrier between a pipe section suspended from the surface or sea floor and the part of the equipment cemented in the well.

When a plug of this type is inserted into the well, the outer diameter thereof is smaller than the diameter against which it is to seal. This means that an elastomeric packer must be compressed in a longitudinal direction so that it expands radially against the tubular wall against which it is to seal. An elastomeric packer utilized in this application can be made of a rubber mixture which resists high temperature and high pressure.

High temperatures soften the elastomeric packer, so it is essential to support the elastomeric packer axially in order to prevent it from being squeezed due to high pressure.

With the present invention, a solution has been found in which support rings are used which support the elastomeric packer in a longitudinal direction when it is in a compressed and expanded state. The solution is carried out in that the support rings expand together with the elastomeric packer to the wellbore wall against which it is to seal. The support rings are designed in such a manner that, in the expanded state, they prevent the elastomeric packer from deforming and extruding into the gap to be sealed as a result of a hydraulic pressure applied thereto.

Hence, the invention relates to a downhole plug with an expandable elastomeric packer having two ends, surrounding a main section. The intended application of the downhole plug is for sealing off wellbores and pipelines. At least one expansion ring adjoins at least one of said two ends of the elastomeric packer, and at least one support ring is provided for applying an axial force in a longitudinal direction of the downhole plug. At least one of said two ends of the elastomeric packer is made with a tapered surface. The at least one expansion ring is made with a tapered surface configured so that the application of an axial force in a longitudinal direction of the downhole plug results in the simultaneous expansion of the elastomeric packer and the at least one expansion ring.

The elastomeric packer may be composed of two outer annular elements and an intermediate annular element wherein each of two outer elements is expandable through their abutment against a sloping bevel or angular face towards the intermediate element.

At least one guide ring with tapered surfaces may assist the expansion of the elastomeric packer and the at least one expansion ring.

One expansion ring and one support ring may be provided at each end of the elastomeric packer.

A ratchet section with a sleeve may be provided in such a manner that axial movement of the sleeve exerts an axial force on the support ring. The ratchet section contains components locking the sleeve against movement in a direction away from the support ring and allowing movement of the sleeve in a direction towards the support ring.

The ratchet section may include wedges having ratchet teeth, a bow spring, a cover, and the main section may include ratchet teeth for engaging the ratchet teeth of the wedges.

A spring package may keep the at least one expansion ring and the elastomeric packer tensioned.

An anchoring section for anchoring the downhole plug in a wellbore or tubular section includes at least one anchor provided with teeth able to grip and hold on to a wall of the wellbore or tubular section.

The downhole plug may further include that an annular fitting, a sleeve, the anchor 31, and at least one of the spring packages slide on a main section so that the application of an axial force on a shoulder of the annular fitting results in the simultaneous activation of the anchor and expansion of the elastomeric packer and the at least one expansion ring.

The elastomeric packer of the invention is composed of three components, of which each of two outer parts are forced out to the wellbore wall against which the packer is to seal through their abutment against a sloping bevel towards an intermediate element.

The invention will now be explained in more detail with reference to an exemplary embodiment and with reference to the drawings, in which.

Figure 1:
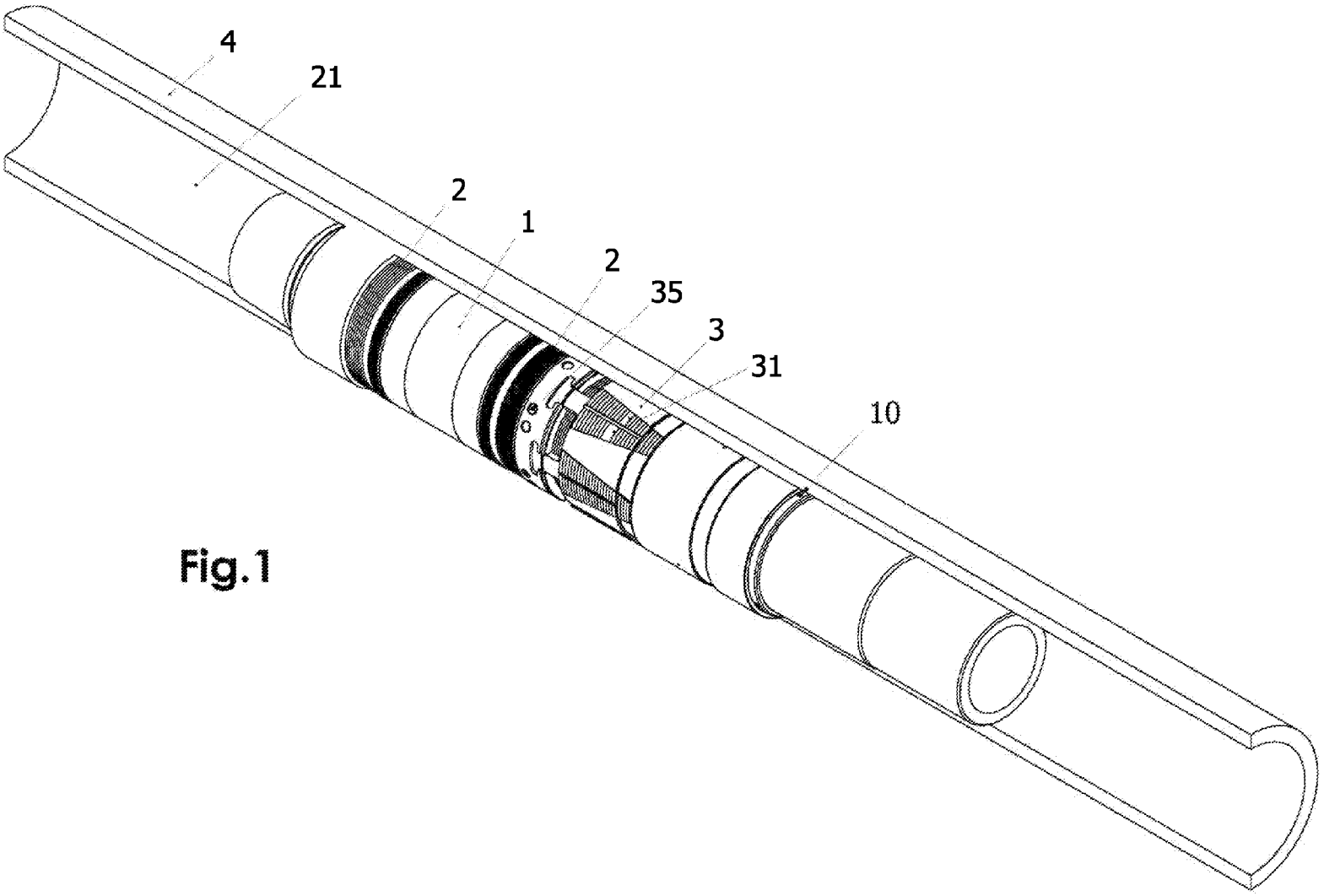
FIG. 1 shows a system overview of the packer tool inside a pipe.
Figure 6:
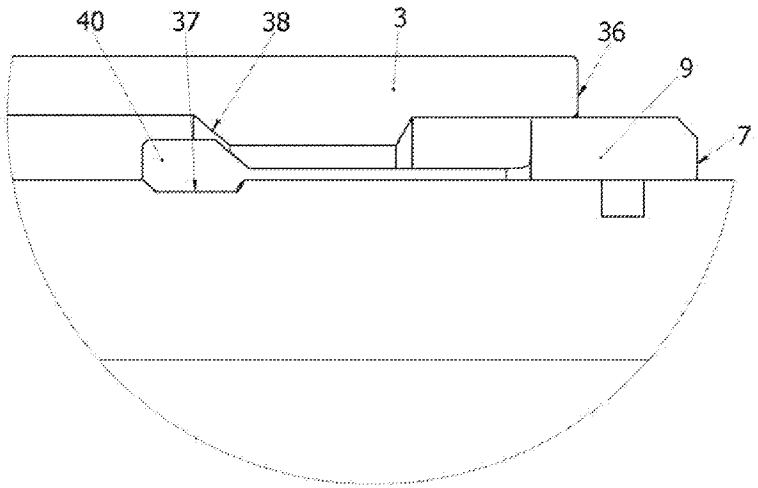
FIG. 6 shows a detail of a safety arrangement preventing the unintended compression of packer elements.
Figure 11:
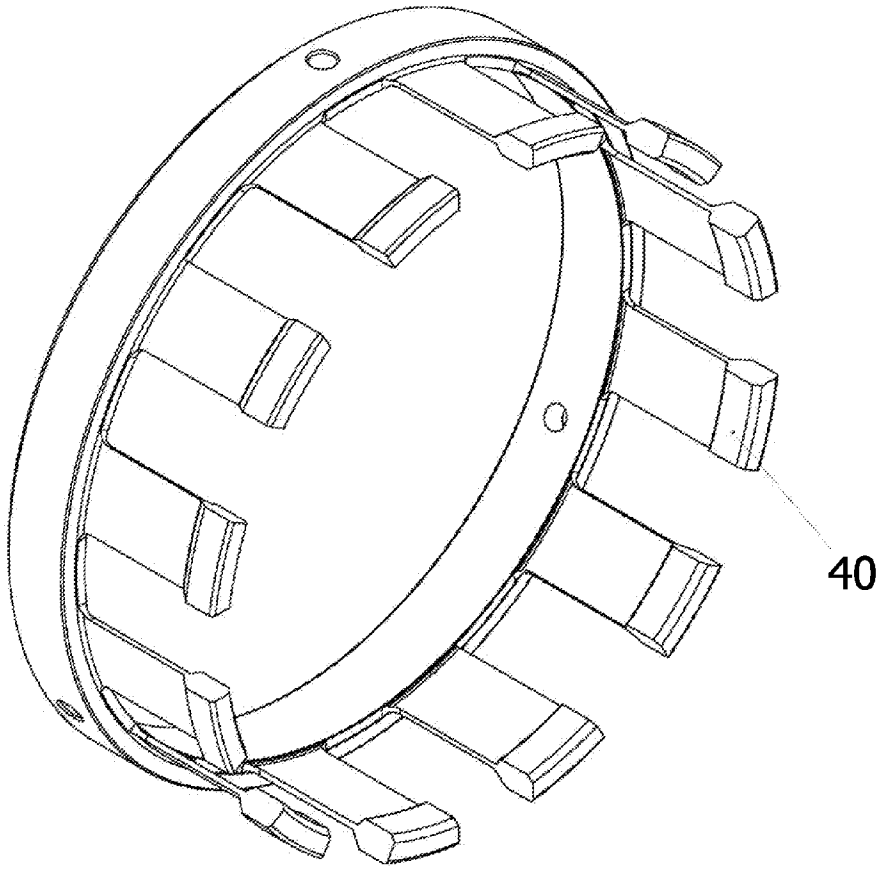
FIG. 11 shows an element having flexible fingers used in the safety arrangement of FIG. 6.

FIG. 1 shows a downhole plug according to an embodiment of the invention, made up by a packer section 1 which is expanded against a tubular conduit 4 against which it is to seal, a spring package 2 maintaining an axial force on packer section 1 when packer section 1 is expanded, an anchoring section 3 for anchoring the plug against a wall 21 of the tubular conduit 4, a ratchet section (shown in FIG. 5) locking packer section 1 and anchoring section 3 in an axial direction when packer section 1 and anchoring section 3 are pressed together axially and consequently expands outwards in a radial direction. Each of the components is mounted on a main section 25 comprising a sealing face 41 for sealing against elastomeric packer 1, shear pin grooves 42 and 43 for the insertion of shear pins 35 and 10, shown in FIG. 1, and ratchet teeth 33 for supporting the axial locking when components are compressed. The plug is axially compressed through the application of a force on shoulder 38, and an axial force 8 is applied between shoulder 36 and main section 25. To avoid compressing the plug before landing on the intended shoulder 7, a safety arrangement is provided, as shown in FIG. 6, with which it is necessary to release an annular fitting 9 locking anchoring section 3 against axial movement between surface 38, fingers 40 as shown in FIG. 11, and which, in turn, are located in a single locking groove 37. The annular fitting 9 itself is held in place by shear pins 10 (FIG. 1). The individual parts described above will now be explained in more detail.

Figure 2:
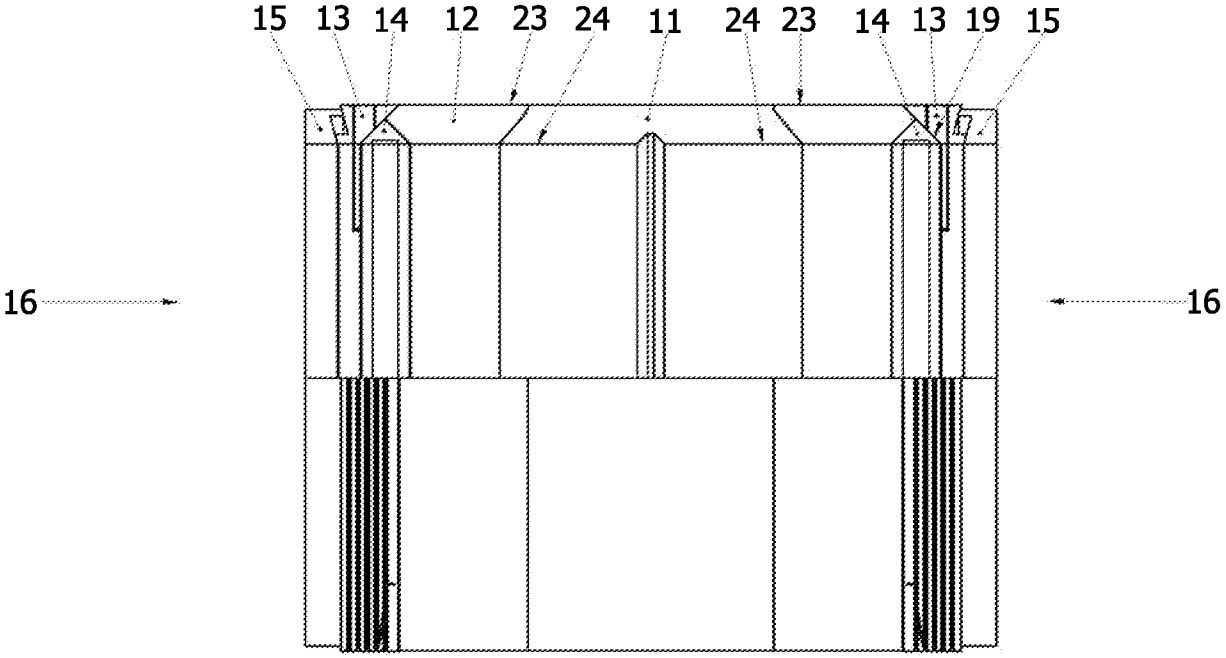
FIG. 2 shows a sectional view of the packer element with support rings.
Figure 3:
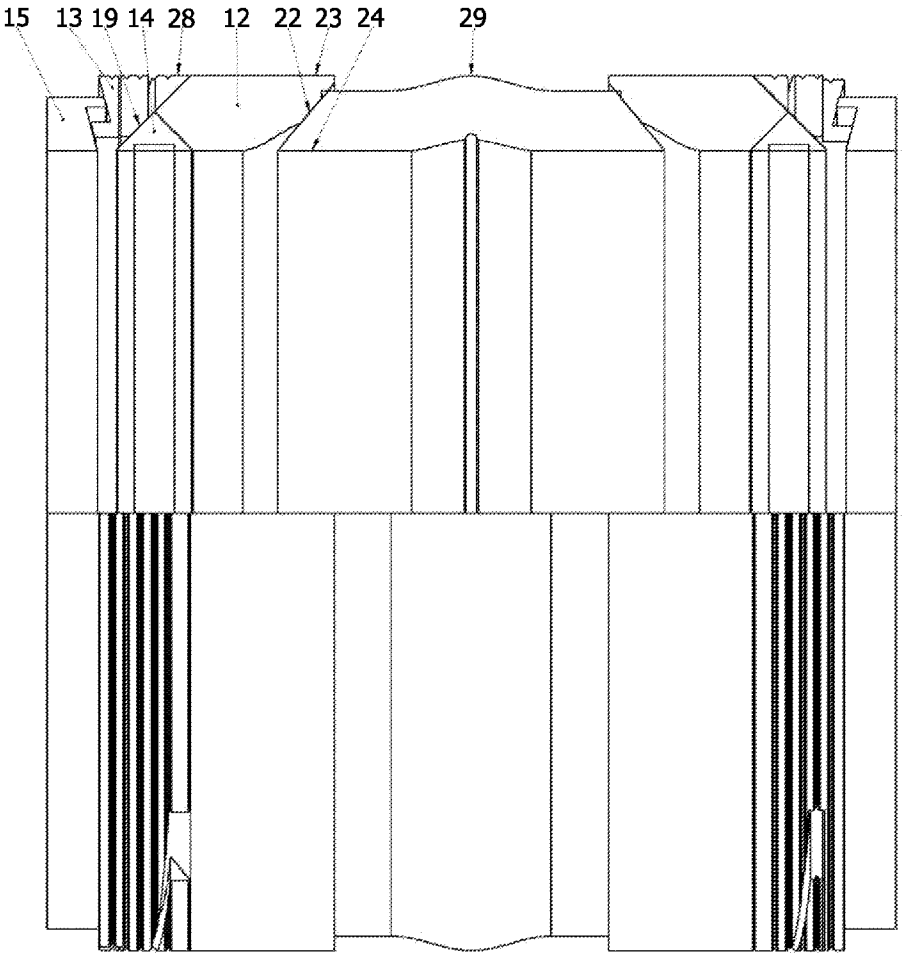
FIG. 3 shows elastomeric packers and support rings in an expanded position.

Packer section 1 is shown in FIG. 2 and is comprised of three elastomeric elements, namely an intermediate element 11 and two outer elements 12. In addition, packer section 1 includes two expansion rings 13, two guide rings 14, as well as two end support rings 15.

Figure 8:
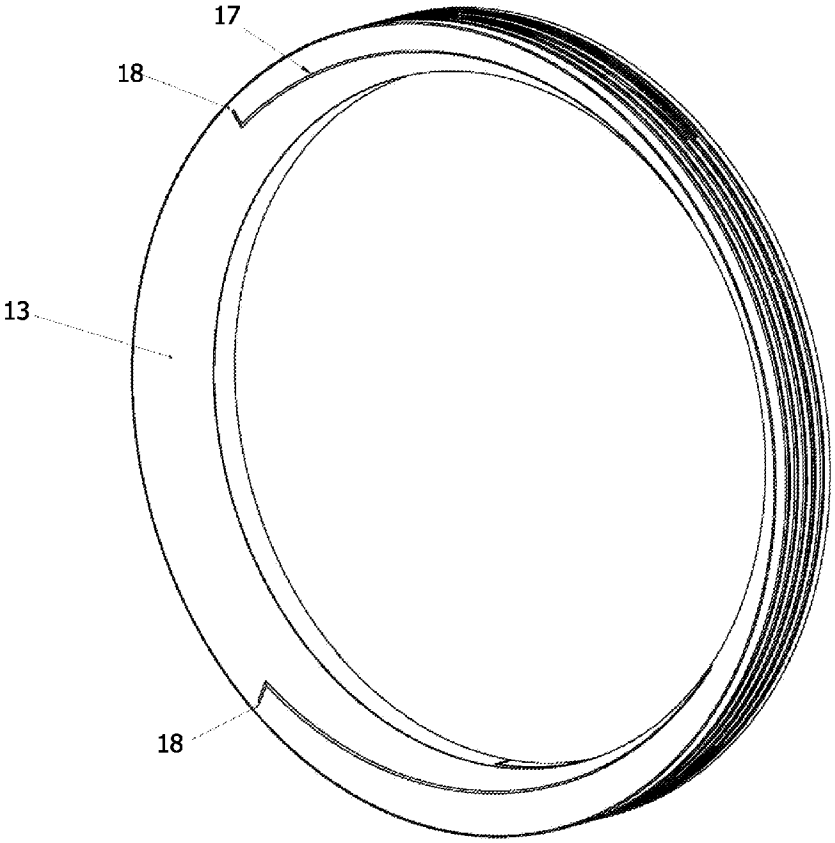
FIG. 8 shows the support ring in an isometric view.
Figure 10:
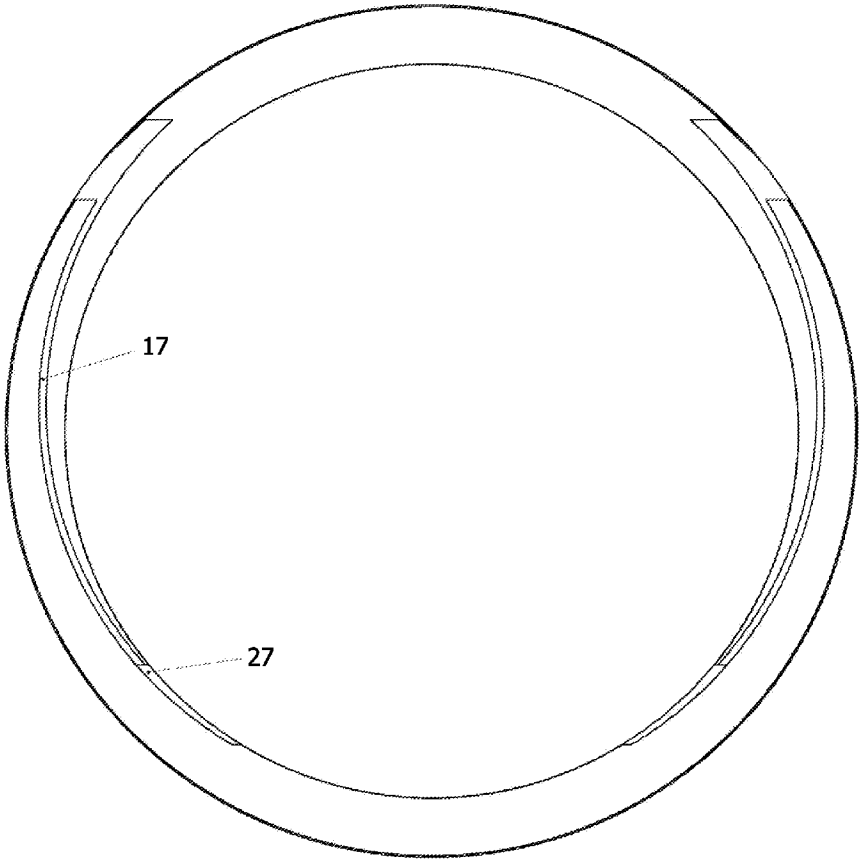
FIG. 10 shows the support ring from the above, in an expanded position.
Figure 9:
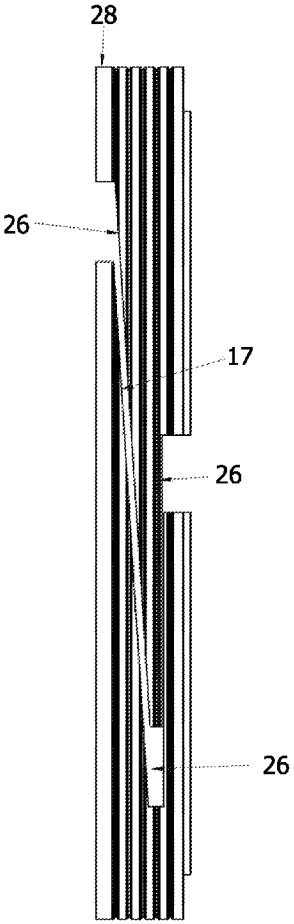
FIG. 9 shows the support ring from the side, in an expanded position.

When packer section 1 is compressed, an axial force 16 is exerted on support rings 15. By means of guide rings 14, expansion rings 13 are pressed radially outwards along guide face 19. Expansion rings 13 are provided with a split groove 17, shown in FIGS. 7-10, allowing the rings to expand radially. At the one end of split groove 17, a frangible piece 18 remains comprising some material (FIG. 8) keeping expansion rings 13 together during assembly and until the axial force 16 (FIG. 2) is applied. When expansion rings 13 are pressed radially outwards by the guiding face 19 of guide rings 14, the frangible piece 18 breaks and expansion rings 13 are split to form a gap 26 (FIG. 9) and are easily expandable in a radial direction. Split groove 17 is slanted so that the point at which the gap opens from underneath 27 (FIG. 10) remains below guiding face 19 of guide ring 14 (FIG. 2). With this, elastomeric packer 12 is prevented from expanding through the split gap 27. Expansion ring 13 expands radially so that the support ring surface 28 fully contacts the tubular wall 21 against which the plug is to seal. Consequently, extrusion of elastomeric elements 11 and 12 is prevented.

On the application of axial force 16, the outer two elastomeric elements 12 will be pressed radially outwards due to the angular face 22 between the intermediate element 11. Thus, when packer section 1 is fully compressed, two seals 23 by the outer elements 12 against tube wall 21 as well as two seals 24 against the main tubular section 25 onto which packer section 1 is mounted, will be formed. In addition, a seal 29 will be formed against tube wall 21 by the intermediate element 11 in that it bends upwards at the centre thereof radially against the tube wall.

Figure 4:
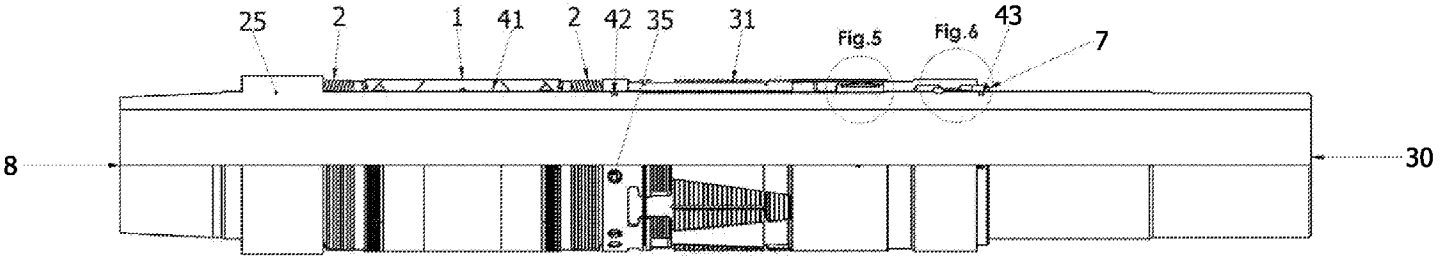
FIG. 4 shows a sectional view of the packer tool.

From FIG. 1 and FIG. 4 it can be seen that on each side of packer section 1, a spring package 2 is provided acting as an axial force accumulator for packer section 1. When such a packer section 1 is compressed, it is desirable to maintain the axial force 16 so that the elastomeric packer remains radially pressed against the tube wall 21 against which it is to seal at all times. Among other things, spring package 2 accommodates axial movement from ratchet teeth 33, as explained in connection with ratchet section shown in FIG. 5.

FIG. 1 shows the anchoring section 3. The downhole plug is constructed so as to be anchored and to support an axial force 30 (FIG. 4). The plug, therefore, is provided with an anchor 31 which is pressed radially outwards when an axial force 8 is applied between main section 25 and shoulder 7 to press together (compress) the components. Anchors 31 are provided with teeth which grip and hold on to tube wall 21. For the components to maintain their position when being inserted into the well, anchoring section 3 is locked in place by means of shear screws 35. The shear screws 35 are sheared through the application of an axial force 8 between main section 25 and shoulder 36.

Figure 5:
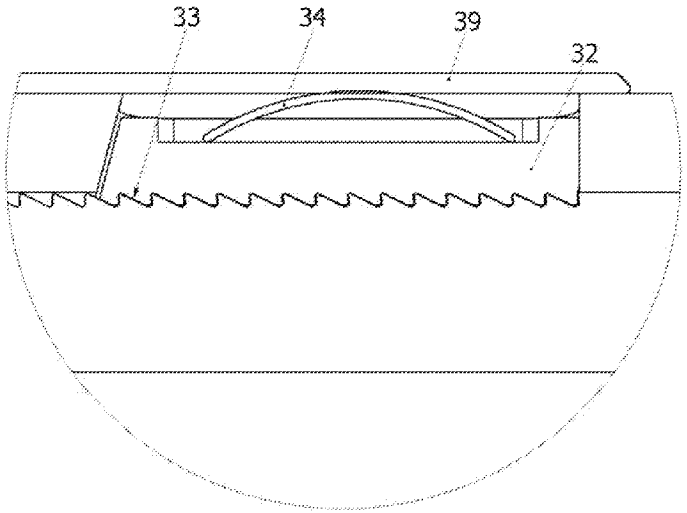
FIG. 5 shows a detail of the racket tooth function.
Figure 7:
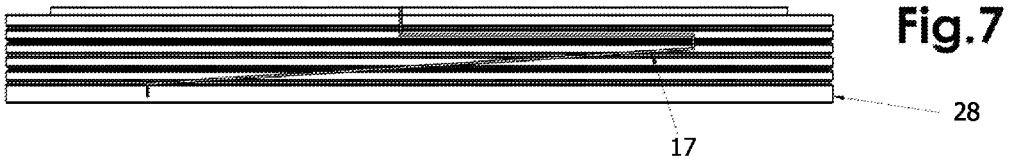
FIG. 7 shows the support ring from the side.

The ratchet section is shown in FIG. 5. When the components of the plug are subjected to an axial force 8 between main section 25 and shoulder 36 and compressed, some means is necessary to lock the axial force 8 in the compressed state. The downhole plug is provided with a ratchet section locking the parts in the compressed state. The ratchet section consists of wedges 32 with ratchet teeth 33, a bow spring 34, and a cover 39. The ratchet teeth 33 of wedges 32 engage ratchet teeth provided on the main section 25 (FIG. 4). The wedges 32 are fitted with a bow spring 34 which is to make sure wedge 32 enters a locked position as it slides along ratchet teeth 33. In addition, the angles of ratchet teeth 33 are chosen so that wedge 32 is pressed inwardly against main section 25 when entering the locked position. Depending on the size of ratchet teeth 33, an axial backward movement will occur when the axial force 8 is released and wedge 32 enters the locked position. This lost force is absorbed by spring package 2.

FIG. 6 shows a safety arrangement. When running into a well, a number of profiles and edges can be encountered. In order to avoid that such profiles and edges engage shoulder 36 to compress the components of the plug, a safety arrangement has been provided making it necessary to hit the targeted shoulder 7 to initiate compression of the plug components. The components are locked in that an annular fitting 9 comprising flexible fingers 40 is locked in locking grooves 37 and that a shoulder 38 prevents movement of anchoring section 3. The annular fitting 9 is locked in place by shear pins 10, shown in FIG. 1. In order to release the annular fitting 9 with the flexible fingers 40 it is necessary to apply force directly on the annular fitting 9 to cut the shear pins 10.

FIG. 11 shows the annular fitting 9 in more detail. Annular fitting 9 includes the flexible fingers 40 having a section which enters into locking groove 37 (FIG. 6). Fingers 40 extend from an annular section with the shoulder 7.

The invention claimed is:

1. A downhole plug with an expandable elastomeric packer (1) having two ends, extending around a main section (25), for use in sealing wellbores and tubulars (4), characterized by:

at least one expansion ring (13) adjoining at least one of said two ends of the elastomeric packer (1) provided with a split groove (17) that can be opened to allow the ring (13) to expand in a radial direction, wherein at the end of the split groove, there is a frangible piece (18) including a small portion of material keeping expansion rings (13) together during assembly and until an axial force (16) is applied, wherein said split groove (17) is slanted at the point at which the gap opens;

at least one guide ring (14) having tapered surfaces conducive to the expansion of the elastomeric packer (1) and the at least one expansion ring (13);

at least one support ring (15) for exerting an axial force (16) in a longitudinal direction of the downhole plug;

at least one of said two ends of the elastomeric packer (1) being provided with a tapered surface; and wherein the at least one expansion ring (13) being provided with a tapered surface configured in such a manner that the application of the axial force (16) in the longitudinal direction of the downhole plug results in the simultaneous expansion of the elastomeric packer (1) and the at least one expansion ring (13).

2. The downhole plug of claim 1, wherein the elastomeric packer (1) is composed by two annular outer elements (12) and an annular intermediate element (11), with each of the two outer elements (12) being expanded through an abutment against a sloping bevel or angular face (22) towards the intermediate element (11).

3. The downhole plug of claim 2, further comprising one expansion ring (13) and one support ring (14) at each end of the elastomeric packer (1).

4. The downhole plug of claim 3, further comprising a ratchet section having a sleeve so that axial movement of the sleeve exert an axial force on the support ring (15), the ratchet section comprising elements locking the sleeve against movement in a direction away from the support ring and allowing movement of the sleeve in a direction towards the support ring (15).

5. The downhole plug of claim 4, wherein the ratchet section includes wedges (32) with ratchet teeth (33), a bow spring (34), a cover (39), and wherein the main section (25) includes ratchet teeth for engaging the ratchet teeth (33) of the wedges (32).

6. The downhole plug of claim 4, further comprising a spring package (2) for keeping the at least one expansion ring (13) and the elastomeric packer (1) tensioned.

7. The downhole plug of claim 2, further comprising a ratchet section having a sleeve so that axial movement of the sleeve exert an axial force on the support ring (15), the ratchet section comprising elements locking the sleeve against movement in a direction away from the support ring and allowing movement of the sleeve in a direction towards the support ring (15).

8. The downhole plug of claim 7, wherein the ratchet section includes wedges (32) with ratchet teeth (33), a bow spring (34), a cover (39), and wherein the main section (25) includes ratchet teeth for engaging the ratchet teeth (33) of the wedges (32).

9. The downhole plug of claim 7, further comprising a spring package (2) for keeping the at least one expansion ring (13) and the elastomeric packer (1) tensioned.

10. The downhole plug of claim 1, further comprising one expansion ring (13) and one support ring (14) at each end of the elastomeric packer (1).

11. The downhole plug of claim 10, further comprising a ratchet section having a sleeve so that axial movement of the sleeve exert an axial force on the support ring (15), the ratchet section comprising elements locking the sleeve against movement in a direction away from the support ring and allowing movement of the sleeve in a direction towards the support ring (15).

12. The downhole plug of claim 11, wherein the ratchet section includes wedges (32) with ratchet teeth (33), a bow spring (34), a cover (39), and wherein the main section (25) includes ratchet teeth for engaging the ratchet teeth (33) of the wedges (32).

13. The downhole plug of claim 11, further comprising a spring package (2) for keeping the at least one expansion ring (13) and the elastomeric packer (1) tensioned.

14. The downhole plug of claim 1, further comprising a ratchet section having a sleeve so that axial movement of the sleeve exert an axial force on the support ring (15), the ratchet section comprising elements locking the sleeve against movement in a direction away from the support ring and allowing movement of the sleeve in a direction towards the support ring (15).

15. The downhole plug of claim 14, wherein the ratchet section includes wedges (32) with ratchet teeth (33), a bow spring (34), a cover (39), and wherein the main section (25) includes ratchet teeth for engaging the ratchet teeth (33) of the wedges (32).

16. The downhole plug of claim 15, further comprising a spring package (2) for keeping the at least one expansion ring (13) and the elastomeric packer (1) tensioned.

17. The downhole plug of claim 14, further comprising a spring package (2) for keeping the at least one expansion ring (13) and the elastomeric packer (1) tensioned.

18. The downhole plug of claim 1, further comprising an anchoring section (3) for anchoring the downhole plug in wellbores or tubulars (4), comprising at least one anchor (31) provided with teeth able to grip and hold on to a wall (21) of the wellbore or tubular (4).

19. The downhole plug of claim 1, further comprising that an annular fitting (9), a sleeve (39), the anchor (31), and at least one of spring packages (2) are slideably arranged on a main section (25) so that the application of an axial force on a shoulder (7) of the annular fitting (9) simultaneously activates the anchor and expands the elastomeric packer (1) and the at least one expansion ring (13).

20. Expansion ring (13) adapted to be located at the end of an elastomeric packer (1) on a well plug and to prevent extrusion of the elastomeric packer (1) when an axial load is applied to the packer, wherein said expansion ring (13) is provided with a split groove (17) that can be opened to allow the ring (13) to expand in a radial direction, wherein at the end of the split groove, there is a frangible piece (18) including a small portion of material keeping expansion rings (13) together during assembly and until an axial force (16) is applied, wherein said split groove (17) is slanted at the point at which the gap opens.

* * * * *